United States Patent [19]

Maue

[11] Patent Number: 4,762,522

[45] Date of Patent: Aug. 9, 1988

[54] AGENT FOR TREATMENT OF HIDES AND PELTS

[75] Inventor: Marilyn J. Maue, Belleville, N.J.

[73] Assignee: GAF Corporation, Wayne, N.J.

[21] Appl. No.: 20,626

[22] Filed: Mar. 2, 1987

[51] Int. Cl.[4] ..... C14C 3/00; C14C 5/00; C14C 9/00

[52] U.S. Cl. ..... 8/94.19 R; 8/94.21; 8/94.23; 252/8.57

[58] Field of Search ..... 8/94.19 R, 94.21; 540/485; 546/243; 548/543; 252/8.57

[56] References Cited

U.S. PATENT DOCUMENTS 3,345,203 10/1967 Kime et al. ..... 8/94.21

FOREIGN PATENT DOCUMENTS 1481508 8/1977 United Kingdom ..... 8/94.21

*Primary Examiner*—Paul Lieberman
*Assistant Examiner*—John F. McNally
*Attorney, Agent, or Firm*—Marilyn J. Maue; Joshua J. Ward

[57] ABSTRACT

A hide or pelt processing agent suitable for use in leather treating compositions comprising a N-alkyl-heterocyclic amide having $C_6$ to $C_{18}$ alkyl substitution on the hetero-nitrogen atom; such as, for example N-octyl-2-pyrrolidone, N-dodecyl-2-pyrrolidone, N-cocoalkyl-2-pyrrolidone and N-tallowalkyl-2-pyrrolidone, employed in an amount between about 0.01 and about 20% by weight based on the total composition of a standard leather treating solution, suspension or emulsion.

The present composition containing one or more of the N-heterocyclic amides can be applied in various curing, tanning and finishing stages of leather treatment to produce processed hides and pelts of improved dyeability, flexibility and moisture content. The present amides can be used directly as an adjuvant in existing formulations to hasten curing and tanning, as an aqueous hydrating solution following beaming, as a sharpening agent in a lime bath for removal of epidermis and hair, as a post-tanning wash solution to prevent curling and minimize shrinkage and, in finishing operations, as a softening, moisturizing and penetrating agent or as an additive to conventional finishing solutions, including bleaching, scouring, fat-liquoring, oiling and/or stuffing solutions, dispersions or emulsions. The present composition is also useful as a dye or pigment carrier to provide improved uniformity and depth of shade in the dyed leather product.

27 Claims, No Drawings

AGENT FOR TREATMENT OF HIDES AND PELTS

BACKGROUND OF THE INVENTION

Although the present invention is not directed to specialized leather processing techniques for obtaining esoteric leather finishes, the present compositions in no way hinder obtaining these effects. A more detailed discussion of specialized processing together with conventional processing procedures can be found in Kirk Othmer's Encyclopedia of Chemical Technology, Volume 10, pages 295–309 and Volume 12, pages 303–341 as well as Modern Practice in Leather Manufacture by J. A. Wilson, 1941, Reinhold Publishing Corp., pages 170–516 and 556–700. The present invention is directed to wet processing treatments of natural and synthetic hides, skins and furs and to the improved penetrating, softening, lubricating and water resistant properties imparted by the present formulations when incorporated in the respective baths employed in leather manufacture. More particularly, the invention is directed to a novel processing aid for hastening and improving soaking, deliming, tanning, fat-liquoring, base coating and finishing of natural or synthetic hides and pelts.

The production of finished leather has many variations depending upon the desired end product and characteristics of the hides but, in general, involves the following basic processing treatments.

Animal hides generally contain about 1% ash, 65–70% water and 30–35% dry substances which include fibrous proteins such as keratin, elastin, reticulin and the leather making protein, collagen, which is responsible for the strength and toughness of the raw hide and whose structural changes are important to ageing. The tanning process consists of a number of collagen-purification steps prior to the actual tanning of the hide. If most of the minor proteins of the hide are not removed before the tanning, they prevent the resulting leather from being soft and flexible.

When a hide is removed from the carcass, the first concern is to preserve or cure that hide so that it is protected until it can be transported to a tannery for manufacture into leather. Curing has been effected by salting the hides in a solid pack in which the hides were laid out flat and covered with a minimum of 1 kg salt/kg hide. The salt dissolved in the water in the hide, forms brine, and dehydrates the hide, thereby inhibiting autolysis and growth of bacteria. After the hides are drained for 30 or more days, they are sorted and bundled for delivery to the various tanners. More modern techniques of curing involve soaking in a saturated salt solution in a raceway that holds several hundred hides which are continually tumbled in a salt solution held at the saturation level. Such treatment removes water from the hide to prevent microbial growth. A bactericide is generally added to assist in preserving the hides. Full salt penetration and dehydration by this more modern method still requires from 18 to 24 hours. Accordingly, there is a need to reduce the curing time in commercial operations. In addition, the cured hides are usually fleshed to remove fatty tissue adhering to their undersides before shipment to tanners. In general pre-tanning treatments include subjecting a pelt to a 20–35 hour cure by a wet process involving immersion in a solution of brine containing bactericide or by a dry green-salt process, such as stacking hides which are layered with dry salt, for a period of 2 to 5 weeks at below room temperature.

Frequently, a pre-wash for the removal of flesh tissue prior to curing is employed. The cured dehydrated hides are then soaked in water for 3 to 30 hours after which beaming is completed. The beamed material is again water washed in the presence of a softening agent, e.g. between about 0.1 and about 0.5% sodium sulfide, soda ash, or sodium tetrasulfide, to effect rehydration. Disinfectants may also be added at this stage to offset bacterial degradation.

The final removal of epidermis and hair is carried out in a series of vats at a temperature ranging from about 50° to about 85° F. by contacting the hide with 10–15% by weight of aqueous saturated lime solution for a period of several days. The liming solution contains calcium oxide, calcium hydroxide and may also include an accelerator or sharpening agent, such as sodium sulfide, sulfhydrate, cyanide salts or dimethylamine, at a concentration of from 2 to 5% by weight of hide. Since the combined effluents from this deliming stage contain between 16 and 18% solids, a serious waste disposal problem exists which is equalled only by the disposal of effluents from bating, soaking, tanning, coloring and fat-liquoring.

The limed hides are then neutralized and bated with buffering agents such as ammonium sulfate or chloride and a proteolytic enzyme, such as trypsin or Oropon, at elevated temperature for the removal and alteration of certain proteins and for reducing the swelling of protein constituents in the skin. The delimed and bated skins are then rinsed with water and are ready for tanning.

Tanning processes are varied and complex but primarily include vegetable tanning for heavy leathers, chrome tanning for lighter hides and skins, or tanning with sulfonated oils, Syntans, or zirconium, alum or iron salts or urea- and/or phenol-formaldehyde resins. A serious problem in the leather industry exists in metal tanning since as much as 25–30% of the metallic agent does not exhaust from the tanning bath into the hide fibers. As a result, a large amount of tannage is lost in draining drums after the initial tanning which results, not only in inefficient use of materials, but also in a serious effluent disposal problem contributing to the pollution of rivers and waterways. Accordingly, an aim of the present invention is to provide for substantially complete exhaustion of the metal onto the leather fibers and, by efficient use of the metal tannage, to reduce the quantity of metal salts required for effective tanning of leather and overall tanning time.

After the initial tanning is completed, the hides may be retanned by one or more of the above processes or they may be passed directly to the finishing stages of processing which include fat-liquoring, at least partial drying, and optionally bleaching, drying and scouring, with, for example, sodium carbonate, sodium hydroxide, hydrated sulfuric acid, sodium bisulfite, sulfurous acid, sulfite cellulose solutions or Syntans. Fat-liquoring with mineral and vegetable oils, soaps or sulfated oil emulsions at 110°–140° F. to lubricate the leather fibers generally follows tanning. The leather may be additionally processed by oiling with sulfated oils or soaps in the presence of an alkaline salt, stuffing with fish oil, mineral oils, oxidized fish oil greases, carnauba, paraffin and other waxes or combinations of these at a higher temperature, e.g. 150°–225° F. to impart water repellency and finally dyeing with acid, base or direct dyes, pigments or lakes and/or spraying with shellac, albumin, lacquer or resins and then mechanically treating to provide gloss, embossing, or napping for desired texture.

It will be appreciated that the above processing steps minimally require several weeks and often require several months of treatment in order to produce a fully processed hide. Accordingly, it is an object of the present invention to reduce the number of finishing steps and to shorten the time required for effecting certain process treatments while providing hides and pelts, including fur pelts, of higher tanning penetration, greater flexibility, moisture-content and resistance to cracking or ageing.

According to this invention, a N-heterocyclic lactam containing from 10 to 24 carbon atoms is employed to replace or augment certain processing solutions in the wet treatment of leather.

The present lactams are those having a 5 to 7 membered ring which are represented by the formula

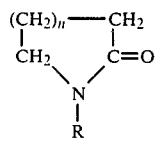

and isomeric forms thereof, wherein n has a value of from 1 to 3 and R is a saturated or unsaturated hydrocarbon radical of 6 to 18 carbon atoms which includes alkyl, alkenyl and alkinyl radicals such as for example, octyl, decyl, dodecyl, tetradecyl, cetyl, heptadecyl, octadecyl, octenyl, decenyl, dodecenyl, hexadecenyl, decinyl, tetradeciny radicals and conjugated and non-conjugated unsaturated hydrocarbon radicals of oils and fats as represented by caprylic, oleic, palmitic, palmitolic, parinaric, undecylic, isanic, myristic, ricinoleic, linoic, linolenic, lauric and stearic acids as well as mixtures of these as found in naturally occurring fats and oils such as tallow oil, cocoa oil, palm oil, animals fats, rapeseed oil, corn oil, linseed oil, tung oil, isano oil, sardine oil, castor beans, and the like. Of these, the N-alkyl and N-olefinically substituted-2-pyrrolidones are preferred and the N-alkyl-, N-tallow- and N-coco-substituted types are most preferred.

The lactams of this invention can be directly incorporated into an existing formulation used in beaming tanning or finishing or an aqueous solution of the lactam may be added to such formulations for better control of concentration when small amounts are required. Also, aqueous solutions of the lactams may be used individually or in combination as the sole active agent to achieve desired results and specific effects.

It is noted that lactams having N-alkyl substitution of $C_8$ to $C_{14}$ preform primarily as surfactants; whereas the primary property of $C_{16}$+N-alkyl lactams is their complexability with other organic and inorganic compounds. However, all of the present lactams possess some degree of surface activity and complexing properties.

As an additive, between about 0.01 and about 10 weight % of the present amides can be incorporated in beaming and/or tanning solutions to impart increased and accelerated penetration of active agents while preserving the softness and flexibility of the hide. As a replacement for an auxiliary treating agent, used primarily in the finishing stages of leather processing to soften, moisturize, fill and/or form an adhesive base coat, and in the pretanning stages, to hasten hide rehydration and loosening of hair or epidermis or to neutralize residual time and provide improved accessibility of the skin for absorption of tannage, between about 0.5 and about 20% of the amide per weight of hide can be employed, as a solution, emulsion, dispersion or suspension in water, mineral or vegetable oils, polyoxyalkylene surfactants, lanolin, sulfonated oils, stearic acid, glycerin, glycols, or petroleum in water emulsions or suspensions.

Incorporation of the present lactams in metal tanning formulations provides for faster and more complete exhaustion of the metal onto the leather fibers so that a reduced amount of metal tannage can be applied to obtain the desired result. The tanning time of operations employing other tannages is also significantly reduced.

Generally, the amount of lactam required to achieve such reduction of processing time or exhaustion of tanning agent onto the hide is preferably between about 0.05 wt. % and 1 wt. %, most preferably between about 0.5 wt. % and about 5 wt. % based on tanning agent.

Utilization of the present amides in leather finishing treatment permits reduction in the number of coats normally required by combining the characteristics of a first or base coat, which provides good skin coverage and adhesion properties for bonding to the skin with the properties of subsequent coatings and finishing agents normally and separately employed for filling, softening, moisturizing and waterproofing. Since the present amides have good skin substantivity as well as moisturizing and viscosity building properties, they are multifunctional agents which accomplish in a single treatment that which has required several separate time consuming treatments to accomplish.

The present lactams are employed in the various treating stages at the temperature normally associated with said treatment under atmospheric pressure.

The present amide compositions provide excellent hide penetration, improved hide lubricity, good distribution of coloring agents and exhibit high tolerance for bactericides, and in some cases actually promote penetration of the bactericide into the epidermal and/or corium layers of the hide. Due to leather lubricating properties, they also possess good release properties in applications where leather embossing is required and have superior solubility or miscibility with water as compared to the oils and greases conventionally employed in leather finishes.

As briefly stated above, an important stage of treatment which can be benefited by addition of the present amides is metal tanning. Tribasic chromium sulfate or sodium dichromate based tannages are cationic and have strong affinity for the fiber protein of leather. However, the rapid exhaustion of chrome from the bath onto the fibers lacks the desired penetrative affect and often clogs the surface pores; thus, a surface protein reaction with consequent incomplete exhaustion of the chrome onto he fibers and inefficient use of the tannage results. Accordingly, processes have been developed to slow the rate of protein/chromium coordination formation to extend the interaction over a period of several days. However, when only 0.5 to 5 weight percent of the present non-ionic amide is added to the chrome salt bath mixture, tanning with deep hide penetration can be completed within 24 hours or less while retaining the degree of softness and hide pliability required for handling. Also the relatively complete exhaustion of metal, e.g. chrome from the treating solution into the leather, avoids serious waste disposal problems. Still further the efficient exhaustion of tanning agent allows for significant reduction in the amount of agent required for a desired degree of tanning. The same benefits are achieved upon addition of the present lactams to other metal tanning solutions, e.g. those employing zirconium, aluminum and ferric salts as well as vegetable tanning solutions.

The addition of lactam also mininizes or obviates the need for immediate addition of oils during tannage or the addition of oils, greases and waxes normaly applied to hide in subsequent stages.

Other benefits realized by the lactams of this invention include reduction in the number of finishing steps, thus providing a more simplified leather manufacturing process and shorter treatment time.

Examples of conventional vegetable tannages which may be combined with the present amides are those which yield catechols or pyrogallols upon distillation. Condensed tannins are of the phenol type; whereas others are esters of glucose or similar sugars with one or more trihydroxybenzoic acids. Generally the tanning agent is a complex blend of these glucosides and phenols. The individual components of the mixture are derived extracts from pods, roots, fruits and leaves, bark or wood of quebracho, wattle, eucalyptus, gambier, valonia, alder, birch, chestnut, spruce, oak, hickory, larch, angica, weeping willow, dhawa, mangrove, algarobilla, cascalote, hazel, tara, manna gum and sumac trees and pomegranate, myrobalam, hannoki and honeysuckle fruits and shrubs.

The original color of the above tannins varies from yellow to brown which is darkened on exposure to light and consequently darkens the hide during treatment. Accordingly, it is beneficial to use as little as possible to achieve a desired tanning effect. The present nonionic surfactant lactams, which are colorless compounds, provide more efficient use of these tanning agent by rapidly transporting them into the pores of the hide and, hence lesser amounts of the tannins are required. Basically, the tannins are astringents which are normally soluble in water, acetone and alcohol but which are insoluble in benzene, ether and chloroform. In acidic medium they transform leather protein into insoluble products which are resistant to decomposition. Specifically, the tannin mixtures of glucosides, various phenols and polyphenols combine with collagen fibers of the skin and liberate sugars. The protein of skins is capable of absorbing large quantities of tannin, to the extent that the weight of skin may be increased up to 350% its weight. However, as in the case of metal tanning, when absorption proceeds too rapidly, the surface pores become clogged so as to prevent further absorption of tannin, and even at lower tanning rates some clogging of surface pores usually occurs, thus causing the skin to become stiff and brittle. The non-ionic lactams of this invention possess the ability to complex with such compounds and transport these tannins into the epidermal and/or corium layer of the skin for more uniform and complete tanning at desirable rates of absorption while maintaining hide softness and pliability.

Syntans are often substituted for vegetable tannins in part or in all of the tanning process. Examples of syntans include condensation products of phenol-formaldehyde, melamine-urea and styrene-maleic anhydride. These may be augmented with a fraction of sulfite cellulose waste liquor, e.g. magnesium lignosulfonate. Since the present amides promote skin penetration, they are also beneficially employed with these tanning agents.

The $C_8$ to $C_{16}$ alkyl, N-tallowalkyl- and N-cocoalkyl-2-pyrrolidones of the present invention possess excellent percutaneous penetration and surfactant properties and thus increase the penetration of formulations containing tannages; fish, vegetable, mineral or animal oils, sulfated oils, oil greases and/or waxes and promote their adherence to the leather. For example, excellent penetration is achieved with the following aqueous formulations of the present lactams which provide examples suitable for incorporation in stuffing, tanning and fixing baths.

| Stuffing | Tanning Additive | Chrome Salt Fixing |
|---|---|---|
| 5–10 wt. % beeswax | 2–6 wt. % stearic acid | 0.4–1.5 wt. % borax or $NaHCO_3$ |
| 20–30 wt. % mineral oil | 0.5–3 wt. % isopropyl myristate | 12–15 wt. % amide* |
| | 0.5–3 wt. % glycerol monostearate | |
| 12–18 wt. % amide* | 0.5–2 wt. % triethanol amine | |
| | 1–10 wt. % sorbitol | |
| | 1–5 wt. % amide* | |

*in the above examples the amide is N—octyl-, N—decyl-, N—dodecyl-, N—cocoalkyl- or N—tallowalkyl- 2-pyrrolidone or mixtures of these heterocyclic amides The N-cocoalkyl-2-pyrrolidone is non-foaming, miscible with water up to about 40% and will form clear and stable aqueous cells above the miscibility level; whereas N-tallowalkyl-2-pyrrolidone is less water soluble but forms creamy gels with water in any proportion. These preferred amides, as well as the individual $C_8$ to $C_{16}$ alkyl lactams can be used with either hydrophilic or lipophilic emulsifiers or fatty acids and stearate based softening agents to enhance lubricity and hide softness.

Other amides falling within the scope of the present invention such as the N-substituted caprolactams and pyridinones are also effective in providing water and moisture barrier properties in the finishing stages of tanned leather. Further, the lactams of the present invention do not lump or agglomerate either in solutions or on the hides or pelts and are compatible with a wide variety of oils, fats, greases and waxes, as well as water and preform as emulsifiers, humectants and softening agents in natural or synthetic vegetable tannages as well as in metal salt and oil tannages.

Representative of compatible oils, fats and waxes are fish, vegetable, animal and mineral oils, sulfonated oils, esters of fatty acids, fatty acids, ethoxylated glyceryl monostearate, fatty alcohols, hydrogenated vegetable oils, fatty alcohol ethers, beeswax, polyethylene, polyhydric alcohols, glycerin, dimethicone, squalane, lanolin, paraffin, ceresin, acetylated lanolin, dimethyl- or methylphenyl-polysiloxanes, phospholipids, sterols, acetylated hydrogenated lard glyceride, corn oil, wheat germ oil, persic oil, petrolatum, neatfoot oil, castor oil, mink oil, sweet almond oil, and animal fats.

Formulations of the present amides beneficially include a hydrophilic and lipophilic emulsifier for converting oils, waxes and fats into solutions or emulsified form. Between about 0.5 and about 12% by weight of a $C_6$ to $C_{22}$ fatty acid, such as myristic, lauric, palmitic, oleic, linoleic, linolenic, stearic and erucic acids, or mixtures thereof, may be combined with between about 0.5 and about 8% by weight of a basic or neutral compound such as ammonia, imidazolidinyl urea, cetyl alcohol, triethanol amide, tripropanol amine, sorbitan, sorbitan sesquioleate, alkali metal salts of lactic, hydracrylic or hydroxybutyric acids, a polyoxylated vegetable oil (e.g. Emulphor ®) an alkali metal borate, and the like. Combinations of these compounds as well as commercially marketed preparations, such as Polysorbate, Carbomer 934, 941, 940, etc., Choleth, i.e. Chloestrol, are among the emulsifiers suitably employed in the formulations of the present invention.

The present formulations may also contain between about 0.5 and about 10% by weight of a polyalcohol, or alkylated or alkoxylated alcohol humectant such as glycerine, sorbitol, mannitol, polyethylene glycol, polypropylene glycol, propylene glycol, butylene glycol, lanolin alcohol, polyoxyethylene glycol, polyoxypropylene glycol, glyceryl stearate, and the like.

Also, between about 0.5 and about 16% by weight of various softening agents such as a fatty acid ester of the types represented by sorbitan monostearate, glycerol monostearate, isopropyl myristate, gluconic acid, myristyl myristate, lauryl lactate etc., may be incorporated in the present amide formulations.

Having generally described the invention, reference is now had to the following examples which illustrate preferred embodiments, but which are not to be construed as limiting to the scope of the invention as more broadly described above and in the appended claims.

EXAMPLE I

The purpose of this example is to demonstrate the advantages derived from the present N-heterocyclic amides when employed as an additive to commercial tanning mixtures. In the following, percentages of chemicals are based on weight of hide, unless indicated otherwise.

Processed ex-light cow hide (150 lbs.) which has been brine cured, rehydrated, beamed, limed and bated is thoroughly rinsed with water and treated with a 2% by weight aqueous solution of lactic acid and is reserved as cleaned hide stock. Twenty-five pounds of the cleaned hide are introduced into a train of a 4 tanning vats containing aqueous solutions of quebrachia tan bark extract of increasing concentration, e.g. 2%, 4%, 6% and finally 10% tanning agent in liquor. The 25 lbs. of hide are treated at a pH of about 3.5 by successive passage through the tanning solutions over a 4 week period. About 14 pounds of tanning extract are employed in this operation. The hides are then passed to a layaway vat where the tanning extract at a concentration of about 10% in the liquor is digested over a two month period. This procedure is conventional and is referenced as Tanning Process A.

Another 25 lbs. of the cleaned hide stock is similarly treated except that only 3 tanning vats are employed containing said tan extract at concentrations of 3%, 5% and 10% to which 2% and 1.5% of N-cocoalkyl-2-pyrrolidone is added in each of the last two vats containing the 5% and 10% tanning liquors. The hides are tanned in these vats for a period of 17 days and digested in the 10% tanning liquor containing 1.5% of said amide in the layaway vat. The entire tanning operation is completed within 6 weeks. This second treatment of hides is referenced as Tanning Process B.

Another 25 lbs. of the above cleaned hide stock is pickled at 75° F. for 16 hours with an aqueous solution containing 15% salt and sufficient sulfuric acid to maintain the pH at about 3. The pickled hide is then soaked for one day at 90°-110° F. in a chrome tan liquor comprising an aqueous solution of 5% sodium dichromate, 2.5% of 30% hydrochloric acid and 5% salt after which the hide is treated in a reduction drum with an aqueous solution containing 15% of sodium thiosulfate to effect release of the chrome from the tanning liquor onto the hide fibers the equivalent to 0.65 grams of $CrO_3$ per 25 lbs. of hide is deposited on the fibers. Butene-1,4-diol can be used to augment or replace sodium thiosulfate in this reduction of the chrome salt. The chromium salt tannage may also be supplemented with a phenol-sulfonic acid condensate (e.g. TANIGAN B). The chromium salt is fixed on the fibers with a 2% aqueous solution of borax in a settling drum, and then washed with 100 gals. of water. This test is referenced as Tanning Process C.

Process C is repeated with an additional 25 lbs. of cleaned hide except that 5% of cocoalkyl-2-pyrrolidone is added to the pickling solution and to the 100 gallons of wash water following tanning. The release of chromium and its coordination to the carbonyl group of the hide protein is equivalent to more than 0.80 grams $CrO_3$ per 25 lbs. of hide. The same increase in chromium deposition is obtained when 2-5% of said amide is added directly to the chrome tanning vat. This test is referenced as Tanning Process D. The increase in chrome deposition for Process D is attributed to the addition of the heterocyclic amide which provides access to carbonyl sites at deeper hide penetration in a shorter period of time. The effluent from this treatment contains only 7% solids as compared with 12% solids in the effluent of Process C, so that only a limited washing is required and solids in the effluent are maintained at a low level.

Process C is again repeated with another 25 lbs. of cleaned hide stock and the chrome-tanned, washed hide is subjected to fat-liquoring at 125° F. for one hour in a rotating drum with an oil-in-water emulsion containing 5% of a blend of neatfoot oil, codfish oil, and sufficient sulfonated oil to render the mixture water soluble. Anionic sulfonated castor oil (e.g. MONOPOL OIL-48) is employed. The ratio of emulsion to hide in this operation is maintained at about 1.5:1. This test is referenced as fat-liquoring Process E.

Fat-liquoring of mineral tanned hides, which are generally rough, stiff and break if bent, is essential to lubricate the fibers and impart pliability and softness. Subsequent treatments also have been generally required for waterproofing, increasing strength and wear resistance, and for many other specific effects.

Process E is repeated except that the oil-in-water emulsion is augmented with 8% of a 60/40 mixture of N-cocoalkyl- and N-tallowalkyl-2-pyrrolidones. This test is referenced as fat-liquoring Process F.

About 10 lbs. of lambskins are subjected to the usual liming, bating, rinshing and pickling steps referred to above. The pickled skins, in plumped condition, are easily split to separate the grain from the flesh layer and the flesh layer is processed for the production of chamois leather. Specifically, the flesh layer of the pelts is depickled at pH 7 with borax at room temperature and the damp skins are treated in a revolving drum for 4 hours with 10% of a cod fish oil-in-water emulsion after which they are piled in layers for 2 days during which the temperature rises 20°-30° while fermentation and oxidation occurs to liberate aldehydes and the collagen of the fibers reacts with the liberated aldehydes in the process of tanning. This oiling process is repeated 3 times in order to achieve 40% incorporation of the oil in the sheep-skin. This process is referenced as Tanning Process G.

Process G is repeated except that the 10% fish oil is replaced with 5% of $C_2$–$C_{10}$ alkyl sulfochlorides, 3% of a 70/30 mixture of N-cocoalkyl- and N-tallowalkyl 2-pyrrolidones and 2% TANIGAN B. This oil process is repeated 3 times with only 2.5 hour fermentation periods to achieve 50% incorporation of oil in the hide. This oil tanning process is referenced as Tanning Process H.

The results of the above tanning processes are summarized in following Table I.

TABLE I

| Process | Fixed Tannage (lbs.) | % Penetration | Boil Test | Flexibility Before or After Liquoring | Softness Before or After Fat-Liquoring | Moisture Resistance of Fat Liquored Leather |
|---|---|---|---|---|---|---|
| A | 7.5 | 50% | slight curl | 0% Before | 10% Before | 20% |
| B | 10 | 65% | no curl | 20% Before | 25% Before | 40% |
| C | 0.65 | 40% | no curl | 5% Before | 20% Before | 40% |
| D | 0.85 | 60% | no curl | 20% Before | 40% Before | 45% |
| E | 0.65 | 40% | — | 50% After | 60% After | 40% |
| F | 0.85 | 60% | — | 75% After | 70% After | 45% |
| G | 0.5 | 40% | — | — | — | — |
| H | 0.7 | 50% | — | — | — | — |

The above improvements in leather tanning are also obtained when employed in a process involving tanning and retanning, such as for example, chrome tanning followed by vegetable tanning, tanning with Syntans or with other metal salts, such as zirconium sulfate and potassium ammonium sulfate. The present N-heterocyclic amides can be added to either or both of the tanning stages as desired or may be used individually in a post tanning treatment in the form of an oil emulsion, suspension or dispersion or water mixture or gel.

EXAMPLE II

After commercial tanning and fat-liquoring, the hides are generally treated with consecutive applications of finish coatings for wear resistance and filling. The first finish coat is commonly referred to as the base coat, and is applied to leather to provide a base for good adhesion of subsequent finish coats and to cover, fill, or hide imperfections in the leather surface. The base coat which is generally pigmented and quite flexible, is followed by subsequent harder finish coats to improve the wear properties of the leather.

Many of the resinous binders presently employed in base coat formulations are deficient in certain properties. For example, when leather, with a base coat, is subjected to a plating or embossing operation, the base coat may cause the leather to stick to the embossing plate. If waxes, casein, and the like, are added to the formulations to improve plate release, the water resistance of the base coat is reduced.

The present N-cocoalkyl-2-pyrrolidone and its mixtures are particularly well adapted for formulation as a base coat preliminary to embossing since it possesses excellent plate release properties, provides a superior water barrier, is amenable to formulation at a high pH, e.g. 7–10, and is thus compatible with subsequent coatings which are unstable at a pH less than 5 or 6. Also, the hydrophilicity of the lactam ring and the lipophilicity of the N-substituent makes the present amines compatible with a wide variety of coating compositions. Further, the amide imparts softening and flexibility to the hide. The amide may be employed in a standard formulation to augment (Formulations I and II) or to replace (e.g. Formulation III) the conventional resinous binders currently in use.

The following formulations (I and II) are typical base coatings to which 5 to 10 weight percent (based on total formulation) of the present N-heterocyclic amides, particularly N-cocoalkyl-2-pyrrolidone or its mixtures, has been added. Formulation III is a new and improved base coat in which the need for an embossing release aid, cross-linking agent, and a major portion of leveling agent are eliminated.

| | Formulation I | Formulation II | Formulation III |
|---|---|---|---|
| Water | 33 parts | 35 parts | 25 parts |
| Cationic leveling agent (20% solids solution) BLANCOL* | 3 | 3.5 | 2 |
| Embossing release aid (15% solids solution) ANTRA** | 6 | 6.5 | — |
| Dulling agent (16% solids dispersion) | 8 | — | 5 |
| Pigment: red iron oxide (10% solids dispersion) | 25.5 | 27 | 30.5 |
| 2% acrolein/5% acrylic acid/40% methyl niethacrylate/53% ethyl acrylate (40% solids dispersion) | 24 | 26.5 | — |
| 28% ammonia | 0.5 | 0.8 | 0.5 |
| Diethylenetriamine | — | 0.7 | — |
| 50/50 mixture of Triethanolamine/stearic acid | — | — | 10 |
| Sorbitol | — | — | 5 |
| N—cocoalkyl-2-pyrrolidone | 10 | 15 | 17.2 |
| Isopropyl myristate | — | — | 0.8 |

*sodium salt of sulfonated naphthalene/formaldehyde condensate
**an acid ester having a hydrophobic base Hides coated with the above formulations possess excellent water resistance after immersion in water for 0.25 hour. Also no bleeding of color or non-uniformity in shade or cracking results.

EXAMPLE III

Cow hide leather coated with the composition of Example II, formulation III, after drying, is suitable for plating or embossing because of its excellent release properties. Plating is effected by heating the leather to between about 200°–230° F. under a pressure up to about 300 tons per square inch pressure to imprint the surface of the leather with a pattern. However, it is to be understood that plating may also be employed to provide a smooth glossy surface to the leather.

The tanning process of Example IE is repeated and the fat-liquored hide is swabbed with a $\frac{1}{4}$ inch coating of Formulation III described in Example II. The leather is then dried and is embossed with an alligator patterned steel plate of a hydraulic press by impressing the hide at a temperature of 215° F. under 100 tons per square inch. The embossed hide is immediately released upon depressurization and elevation of the steel plate, the design embossed hide has good permanency (no deformation after inspection 2 months later).

It is to be understood that the above embossing technique employing any of the formulations of this invention, described in Example II and elsewhere, can be applied to synthetic leathers such as Neolite, corfam as well as to natural hides and pelts. Additionally, the embossing or plating procedure described can be replaced with any of the known alternatives.

EXAMPLE IV

Formulations including the N-tallowalkyl-2-pyrrolidone of the present invention possess even stronger water resistant properties than the N-cocoalkyl derivative. Whereas the formulations containing N-cocoalkyl-2-pyrrolidone provide a smooth, high slip surface, the N-tallowalkyl-homolog provides a somewhat waxy texture which is most beneficial in cases where subsequent coatings require good adhesion, e.g. lacquer, shellac or enamel coatings.

In accordance with this need, the process of Example 1D is repeated except that pickling is carried out in the absence of N-cocoalkyl-2-pyrrolidone and instead, 2.5% N-tallowalkyl-2-pyrrolidone is added to the tanning bath containing sodium dichromate. After washing with 100 gallons of water the hides are rinsed with a naphtha solution. A small portion of boiled, naphtha-based linseed oil paste containing 28% carbon black is daubed and rubbed into the hide to provide a 0.0025 inch thick coating. The skin is dried at about 105° F. After reboiling and addition, to the remaining portion of the daub paste, of 2 weight % N-tallowalkyl-2-pyrrolidone and sufficient naphtha to reduce the consistency to a pourable liquid, a second 0.0025 inch coating is applied to the hides. The hides are dried at about 135° F. and the final varnish coat of boiled linseed oil, thinned to a watery consistency with naphtha and containing a small amount of lead oxide and pigment are applied in a coat thickness of 0.005 inch. Final drying is effected at about 150° F. and exposure to ultraviolet light for a period of 5 hours.

The finished dried patent leather has a deep rich black color and superior resistance to peeling and deep linear cracking. The surface of the leather is smooth and without tack.

Compositions containing the present N-heterocyclic amides, particularly, the N-alkyl- and N-cocoalkyl- and N-tallowalkyl-2-pyrrolidones, find many other applications in the processing of leather which are not illustrated in the Examples. These include samming, scouring, bleaching, and wet processing of furs, such as dressing, pickling and boiling or greasing as well as tanning with aluminum salts, formaldehyde resins, ferric salts and vegetable tannins to provide better penetration of active ingredients into the pelts.

These and many other modifications and additions will become apparent from the above description and disclosure.

What is claimed is:

1. A leather processing composition containing an effective leather penetrating amount of an N-heterocyclic amide having the formula

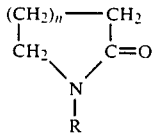

wherein n has a value of 1 to 3 and R is an aliphatic hydrocarbon radical of from 6 to 18 carbon atoms.

2. The composition of claim 1 wherein R is selected from the group of $C_6$ to $C_{18}$ alkyl, tallowalkyl, cocoalkyl and mixtures thereof.

3. The composition of claim 2 wherein said N-heterocyclic amide is N-cocoalkyl-2-pyrrolidone, N-tallowalkyl-2-pyrrolidone or mixtures thereof.

4. The composition of claim 1 wherein said composition is an aqueous composition.

5. The composition of claim 1 wherein the N-heterocyclic amide is contained in an inert carrier and wherein the effective amount of said N-heterocyclic amide is between about 0.01 wt. % and about 20 wt. % based on weight of hide.

6. The composition of claim 5 wherein said inert carrier is water.

7. The composition of claim 1 wherein said composition contains an emulsifier mixture of from about 2 to about 25 weight percent of a fatty acid and from about 0.1 to about 5 weight percent of a base selected from the group consisting of triethanol amine, an alkali metal lactate, ammonia and an alkali metal borate and mixtures thereof.

8. The composition of claim 1 wherein said composition additionally contains between about 0.5 and about 15 weight percent of a fatty acid ester surfactant selected from the group consisting of isopropyl myristate, myristyl myristate, lauryl lactate, glycerol monostearate and mixtures thereof.

9. The composition of claim 1 wherein said composition additionally contains between about 0.5 and about 12 weight percent of a humectant selected from the group consisting of propylene glycol, ethylene glycol, a polyoxyalkylene glycol, polyalkylene glycol, sorbitol and glycerine.

10. The process of utilizing an effective hide penetrating amount of the compound of claim 1 as a leather processing aid.

11. The process of claim 10 wherein said compound is an N-alkyl-2-pyrrolidone, N-cocoalkyl-2-pyrrolidone or N-tallowalkyl-2-pyrrolidone or a mixture thereof.

12. The process of claim 10 wherein the amount of said compound employed is between about 0.01 and about 20% per weight of hide.

13. The process of claim 12 wherein the amount of said compound is between about 0.05 and about 10% per weight of hide.

14. The process of claim 10 utilizing said compound in fat-liquoring bath at a temperature of from about 100° to about 150° F.

15. The process of claim 10 utilizing said compound as an additive to the leather tanning bath at a temperature of from about 75° to about 125° F.

16. The process of claim 15 wherein the tanning bath contains a chromium salt tanning agent.

17. The process of claim 15 wherein the tanning bath contains a vegetable extract tanning agent.

18. The process of claim 15 wherein the tanning bath contains a syntan tanning agent.

19. The process of claim 10 wherein said compound is added to a saturated salt solution used in curing of hides.

20. The process of claim 10 wherein said compound is added to a dyeing solution applied to a hide.

21. The process of claim 10 wherein said compound is added to a leather bleaching solution applied to a hide.

22. The process of claim 10 wherein said compound is added to a leather defleshing bath.

23. The process of claim 10 wherein said compound is added to a leather post tanning washing solution.

24. The process of using an effective hide softening amount of the compound of claim 1 in at least one stage of leather processing.

25. The process of using an effective viscosity building amount of the compound of claim 1 in a leather processing treatment.

26. The process of using an effective lubricating amount of the compound of claim 1 in a leather oiling treatment.

27. The process using an effective dispersion promoting amount of the compound of claim 1 in a leather coating composition.

* * * * *